US011015880B2

(12) United States Patent
Hung

(10) Patent No.: US 11,015,880 B2
(45) Date of Patent: May 25, 2021

(54) THIN HEAT EXCHANGE PANEL

(71) Applicant: Chiang-Sen Hung, Taichung (TW)

(72) Inventor: Chiang-Sen Hung, Taichung (TW)

( * ) Notice: Subject to any disclaimer, the term of this patent is extended or adjusted under 35 U.S.C. 154(b) by 24 days.

(21) Appl. No.: 16/731,052

(22) Filed: Dec. 31, 2019

(65) Prior Publication Data

US 2020/0132396 A1 Apr. 30, 2020

(51) Int. Cl.
*F28F 21/00* (2006.01)
*F28F 3/14* (2006.01)
*F28F 13/08* (2006.01)

(52) U.S. Cl.
CPC ..... *F28F 3/14* (2013.01); *F28F 13/08* (2013.01); *F28F 2250/08* (2013.01); *F28F 2250/104* (2013.01)

(58) Field of Classification Search
CPC ..... F28F 3/14; F28F 13/08; F28F 2250/08; F28F 2250/104
USPC ..... 165/180
See application file for complete search history.

(56) References Cited

U.S. PATENT DOCUMENTS 6,988,534 B2 * 1/2006 Kenny ..... F04B 17/00 165/104.21
2010/0290190 A1 * 11/2010 Chester ..... H05K 7/20772 361/701
2011/0317369 A1 * 12/2011 Pautsch ..... H01L 23/473 361/702
2013/0025831 A1 * 1/2013 Attinger ..... H01L 23/473 165/104.27

* cited by examiner

*Primary Examiner* — Davis D Hwu

(57) ABSTRACT

A thin heat exchange panel includes a contact side that is in contact with a heat source and a plurality of heat exchange channels disposed in the contact side. A water inlet channel of the heat exchange panel is connected with a high-pressure pump for inputting high-pressure water, and a water outlet channel of the heat exchange panel is connected with a cooler to form a circulating cooling system. When the high-pressure pump is started, the high-pressure water quickly enters the water inlet channel. Reduced control holes communicating with the water inlet channel are configured to regulate the average flow rate and increase the speed of the water to bring a high-speed jet effect, which improves the heat exchange rate of the water in the heat exchange channels to achieve the effects of low damping, high heat dissipation efficiency and thinning.

7 Claims, 10 Drawing Sheets

THIN HEAT EXCHANGE PANEL

FIELD OF THE INVENTION

The present invention relates to a heat exchange panel, and more particularly to a thin heat exchange panel with high-efficiency heat dissipation for electronic components that easily generate high heat.

BACKGROUND OF THE INVENTION

As to various heating components including motors, batteries, computer hosts, computer room hosts, overheating will affect efficiency, and heat dissipation is an important factor in system stability.

In the past, computers used an air cooling mode to dissipate heat. Using the air cooling mode is no longer sufficient to meet the cooling requirements of high-speed computer computing. Therefore, a water cooling system has become one of the important technologies for heat dissipation of high-speed computing systems.

As shown in FIG. 1, the traditional water cooling method mainly uses a pump to convey the cold liquid cooled by a cooler (heat sink) to a heat exchanger to absorb the heat of the heat source, and then the heated liquid after heat absorption is returned to the cooler for cooling, so as to form a cooling liquid circulation system 1.

As shown in FIG. 2 and FIG. 2A, a conventional heat exchanger includes a water container 2. One end of the water container 2 is connected with a liquid inlet pipe 3, and the other end of the water container 2 is connected with a liquid outlet pipe 4. The opening of the water container 2 is provided with a heat-absorbing panel 5. The heat-absorbing panel 5 is provided with a plurality of heat dissipation fins 6. The plurality of heat dissipation fins 6 are accommodated in the water container 2. When the cooling liquid flows into the liquid inlet pipe 3 of the conventional heat exchanger and is discharged from the liquid outlet pipe 4, the cooling liquid will find the shortest path as the flow path between the liquid inlet pipe 3 and the liquid outlet pipe 4 due to Bernoulli's principle, and will not pass through each heat dissipation fin 6. As a result, the heat absorption capacity of the conventional heat exchangers is greatly reduced. In addition, the conveying capacity of the pump will form a large damping force when it is in cooperation with small-diameter tubes, so that corresponding size requirements are required for inlet and outlet tubes, resulting in a larger volume of the conventional heat exchanger.

As shown in FIG. 3, in order to improve the shortcomings of the conventional heat exchanger described above, a meandering heat exchanger 7 is developed. Through a meandering water channel 8, the heat exchange area is maximized. However, it is a long distance for the cooling liquid in the meandering water channel 8 to pass, as shown in FIG. 3A. The cooling liquid reaches temperature saturation in the middle section after absorbing heat in the front section, which makes the heat-absorbing efficiency of the rear section worse and makes the heat dissipation of the heat exchanger uneven. Besides, the impedance of the meandering water channel 8 is large. Because the inlet and the outlet must meet the requirement for the large tubes of the pump, the thickness of the panel of the meandering heat exchanger 7 is thicker, and the volume is larger.

Accordingly, the inventor of the present invention has devoted himself based on his many years of practical experiences to solve these problems.

SUMMARY OF THE INVENTION

The primary object of the present invention is to provide a thin heat exchange panel, comprising at least one contact side that is in contact with a heat source and a plurality of parallel and upright heat exchange channels disposed in the contact side. Two ends of each heat exchange channel communicate with a water inlet channel for inputting high-pressure water and a water outlet channel connected to a cooler, respectively. A reduced control hole is disposed between each heat exchange channel and the water inlet channel.

A cross-sectional area of each reduced control hole is added up, which is less than or equal to a cross-sectional area of the water inlet channel. A cross-sectional area of each heat exchange channel is added up, which is less than or equal to a cross-sectional area of the water outlet channel. The cross-sectional area of the water inlet channel is less than the cross-sectional area of the water outlet channel.

With the above structure, the contact side of the heat exchange panel is in contact with the heat source, and the water inlet channel is connected with a high-pressure pump for inputting the high-pressure water, and the water outlet channel is connected with the cooler to form a circulating cooling system. When the high-pressure pump is started, the high-pressure water quickly enters the water inlet channel. The reduced control hole regulates the average flow rate and increases the speed of the water to bring a high-speed jet effect, which improves the heat exchange rate of the water in the heat exchange channels to achieve the effects of low damping, high heat dissipation efficiency and thinning.

Preferably, a cone-shaped flared channel is disposed between each reduced control hole and each heat exchange channel. Through the flared channel, a dead angle between the reduced control hole and the heat exchange channel is avoided, and the space of each heat exchange channel is used effectively.

Preferably, the heat exchange panel is formed by combining at least two panel bodies. Through the at least two panel bodies, the heat exchange panel can be easily processed and manufactured.

Preferably, the water inlet channel is connected to a water inlet pipe. The high-pressure water from the high-pressure pump is conveyed into the water inlet channel through the water inlet pipe. The water outlet channel is connected to a recycling water pipe. The cooling liquid after absorbing heat is returned to the cooler through the recycling water pipe.

Preferably, the cross-sectional area of each reduced control hole is adjustable according to a flow demand.

Preferably, the cross-sectional area of each reduced control hole is gradually enlarged from the reduced control hole close to a water inlet end of the water inlet channel to the reduced control hole close to a tail closed end of the water inlet channel.

Preferably, the cross-sectional area of each reduced control hole is incrementally set from the water inlet end to the tail closed end.

Embodiments of the present invention will now be described, by way of example only, with reference to the accompanying drawings.

DETAILED DESCRIPTION OF THE PREFERRED EMBODIMENTS

Figure 1:
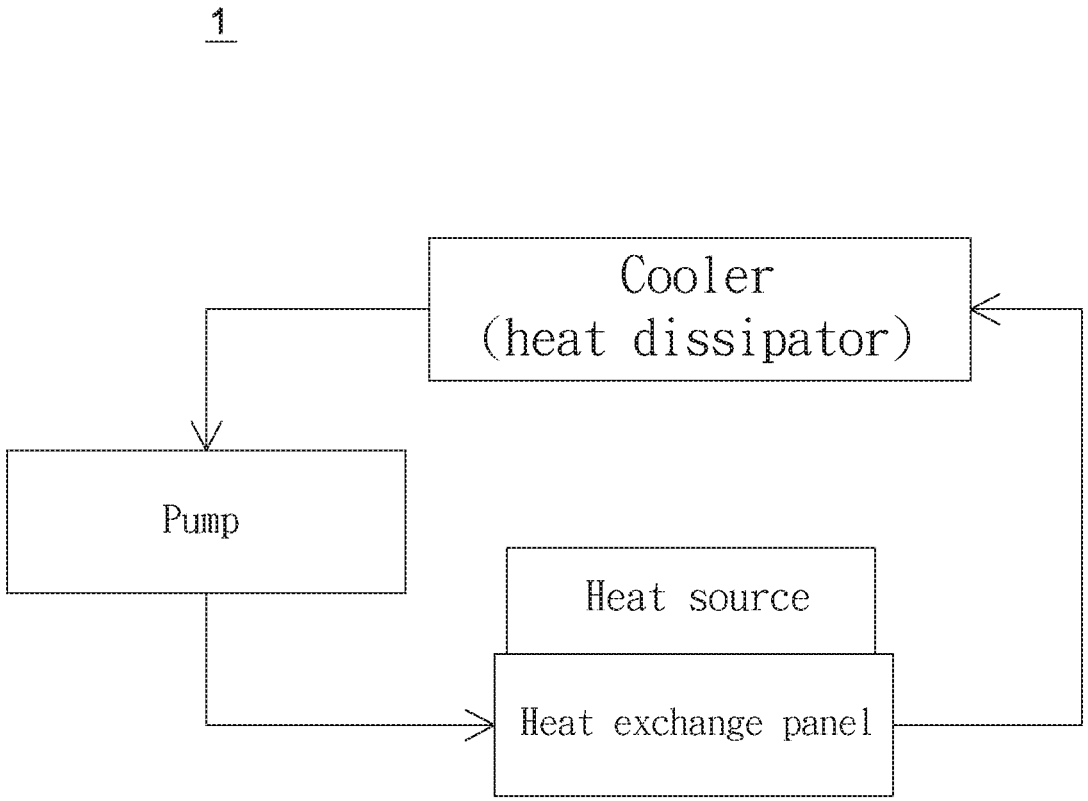
PRIOR ART FIG. 1
FIG. 1 is a block diagram of a conventional cooling liquid circulation system.
Figure 2:
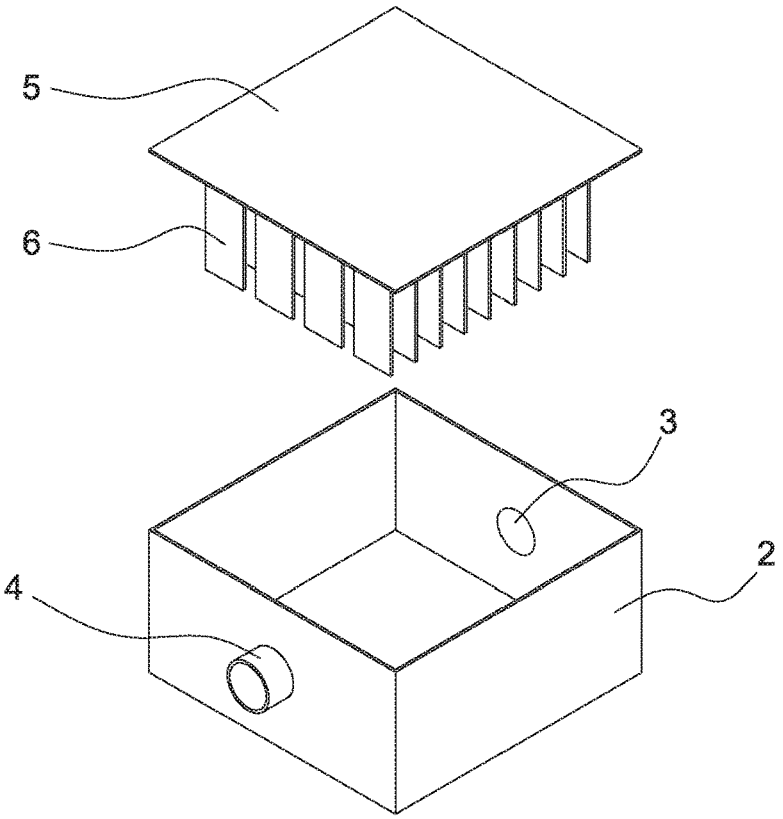
PRIOR ART FIG. 2
FIG. 2 is an exploded view of the conventional cooling liquid circulation system.
Figure 2A:
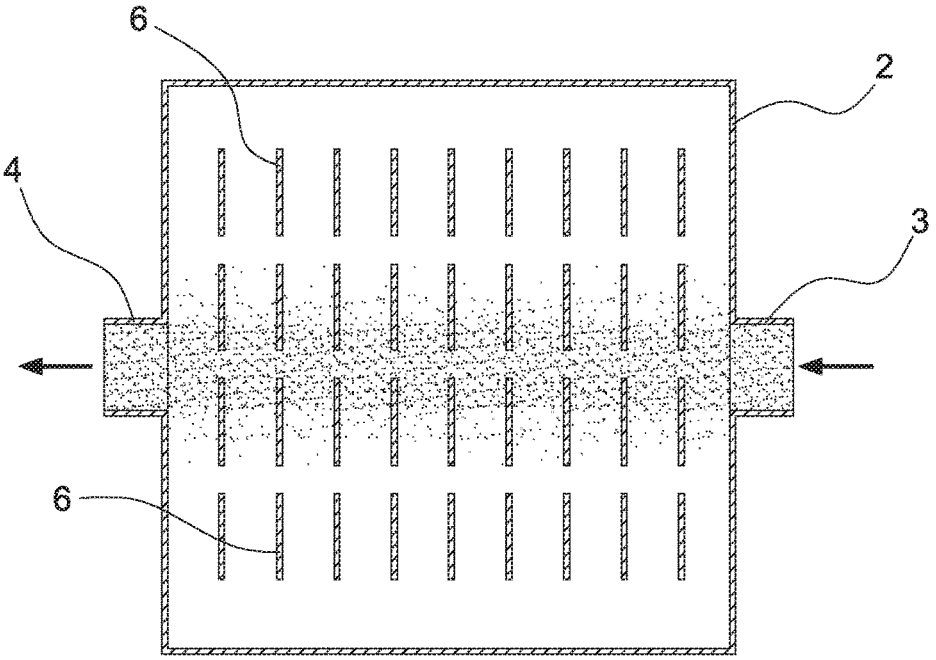
PRIOR ART FIG. 2A
FIG. 2A is a cross-sectional view of the conventional cooling liquid circulation system.
Figure 3:
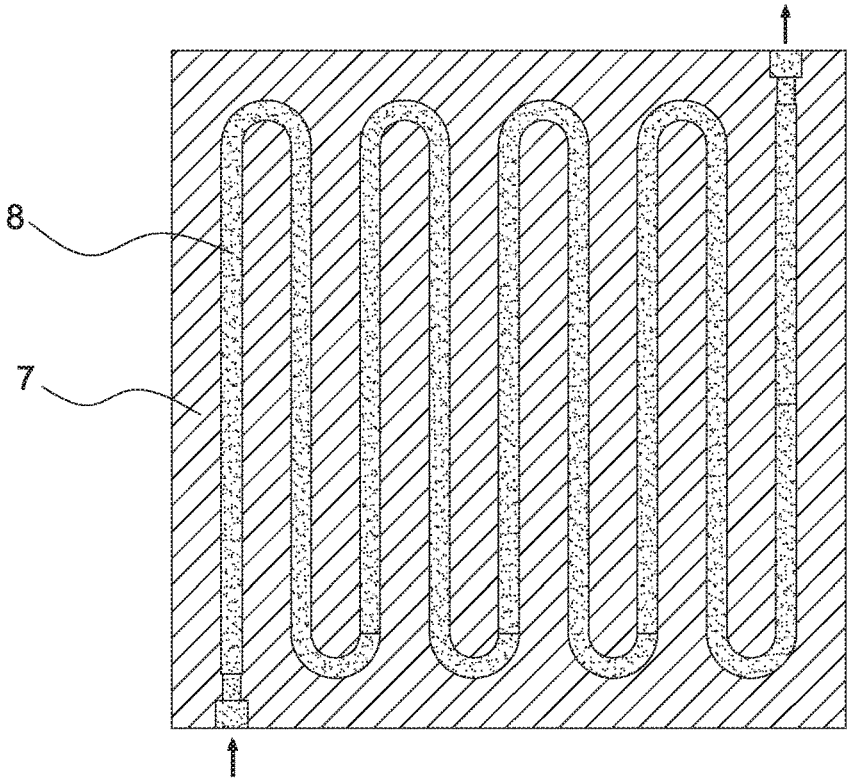
PRIOR ART FIG. 3
FIG. 3 is a cross-sectional view of another conventional cooling liquid circulation system.
Figure 3A:
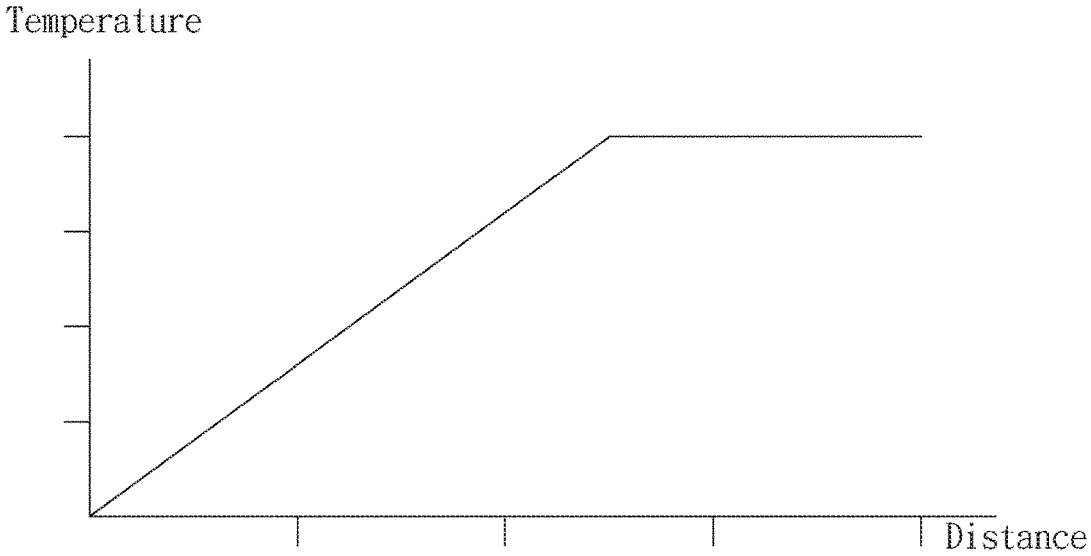
PRIOR ART FIG. 3A
FIG. 3A is a diagram showing the change in distance and temperature of the cooling liquid used in the conventional cooling liquid circulation system.
Figure 4:
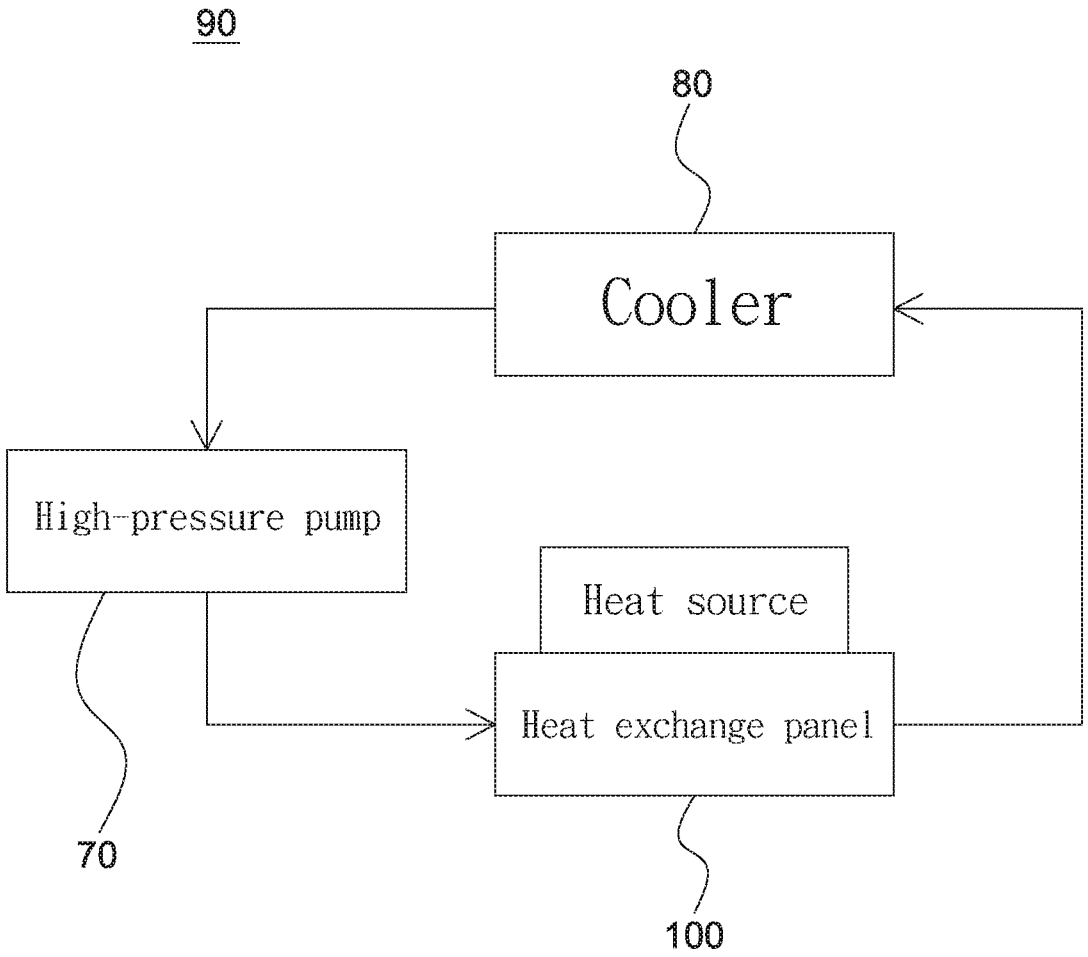
FIG. 4 is a block diagram of the circulating cooling system of the present invention.

Referring to FIG. 4 to FIG. 7A, the present invention discloses a thin heat exchange panel 100, comprising at least one contact side 10 that is in contact with a heat source and a plurality of parallel and upright heat exchange channels 20 disposed in the contact side 10. Two ends of each heat exchange channel 20 communicate with a water inlet channel 30 for inputting high-pressure water and a water outlet channel 40 connected to a cooler 80, respectively. A reduced control hole 50 is disposed between each heat exchange channel 20 and the water inlet channel 30.

The cross-sectional area of each reduced control hole 50 is added up, which is less than or equal to the cross-sectional area of the water inlet channel 30. The cross-sectional area of each heat exchange channel 20 is added up, which is less than or equal to the cross-sectional area of the water outlet channel 40. The cross-sectional area of the water inlet channel 30 is less than the cross-sectional area of the water outlet channel 40.

With the above structure, the contact side 10 of the heat exchange panel 100 is in contact with the heat source, and the water inlet channel 30 is connected with a high-pressure pump 70 for inputting the high-pressure water, and the water outlet channel 40 is connected with the cooler 80 to form a circulating cooling system 90. When the high-pressure pump 70 is started, the high-pressure water quickly enters the water inlet channel 30. The reduced control hole 50 regulates the average flow rate and increases the speed of the water to bring a high-speed jet effect, which improves the heat exchange rate of the water in the heat exchange channels 20 to achieve the effects of low damping, high heat dissipation efficiency and thinning.

Figure 8:
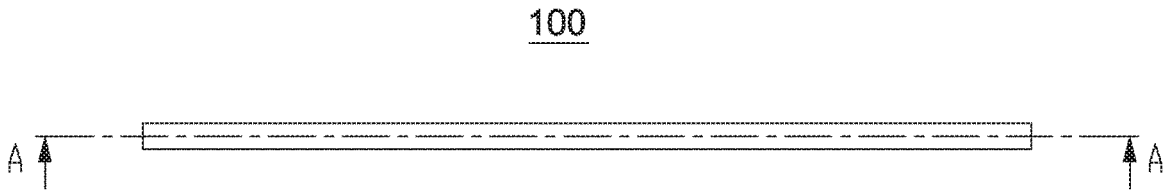
FIG. 8 is a top view of the present invention.
Figure 8A:
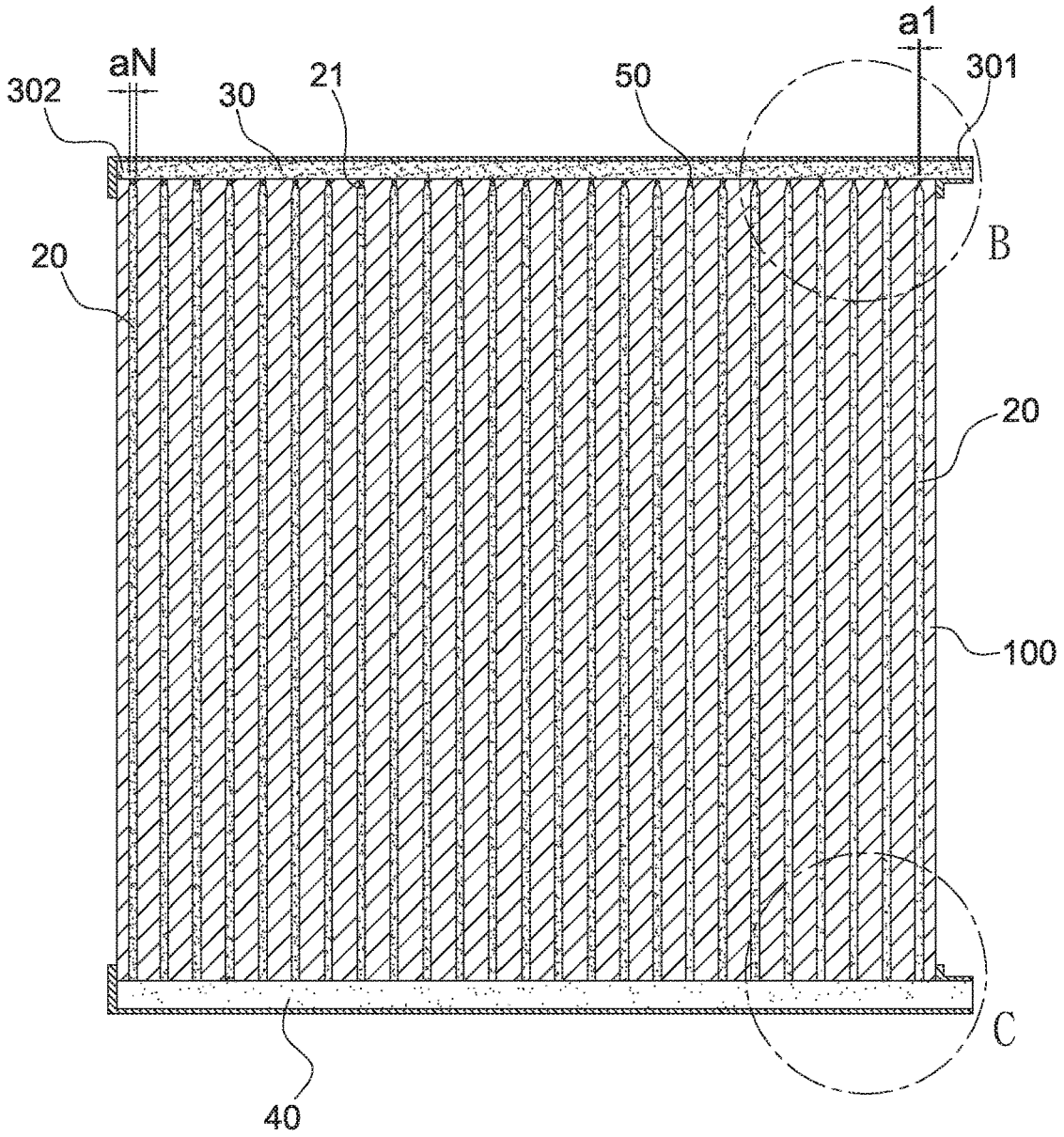
FIG. 8A is a cross-sectional view of the present invention.
Figure 8B:
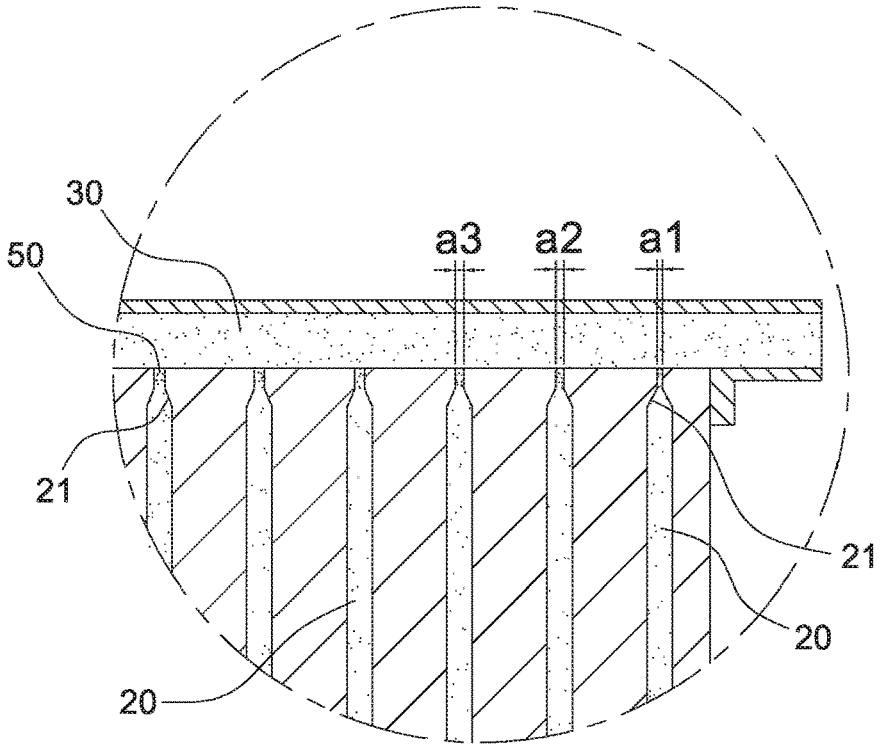
FIG. 8B is an enlarged view taken from circle B of FIG. 8A.
Figure 8C:
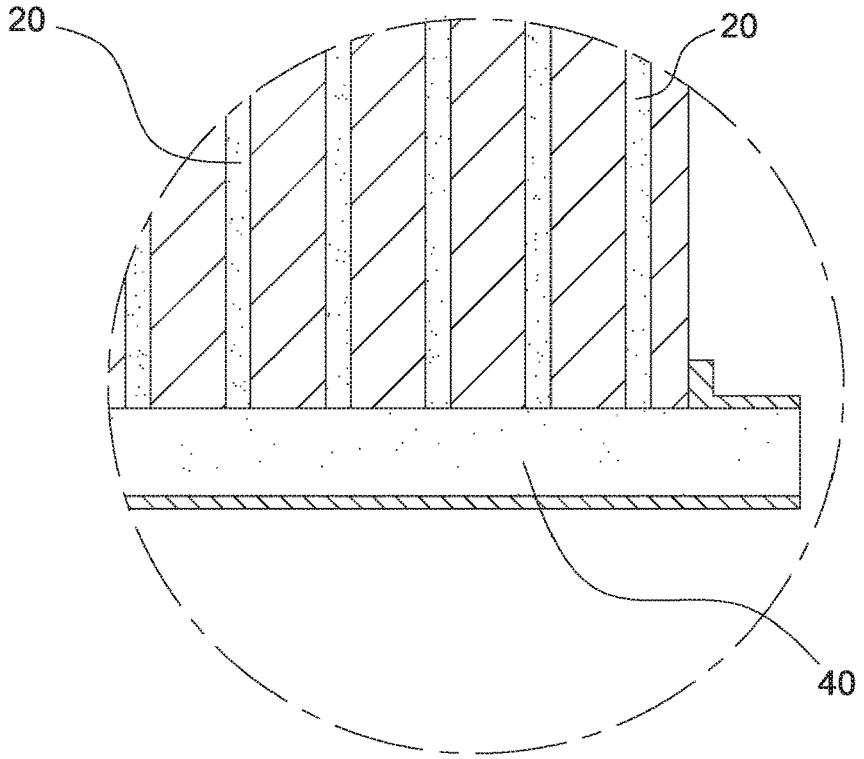
FIG. 8C is an enlarged view taken from circle C of FIG. 8A.
Figure 9:
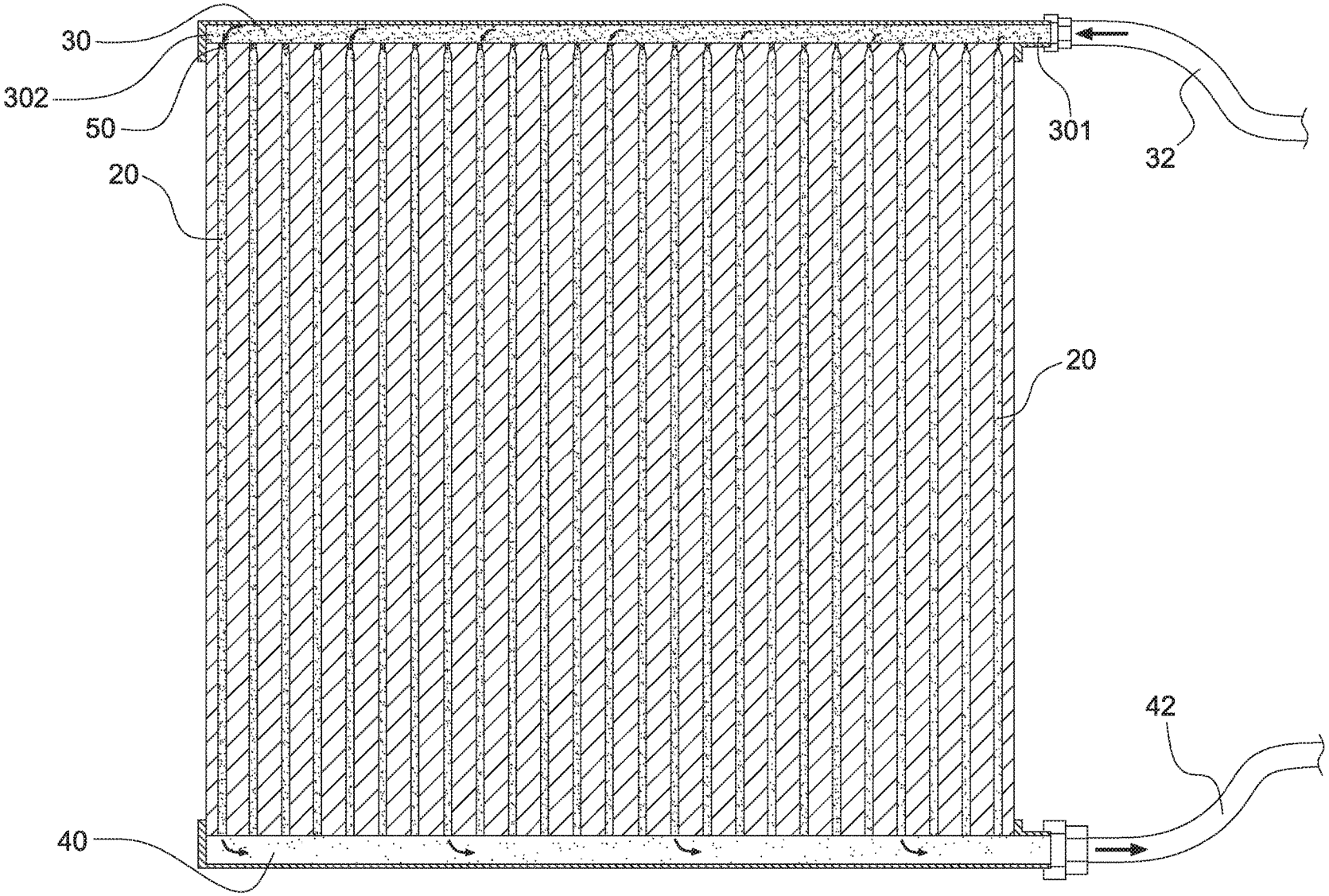
FIG. 9 is a schematic view showing the operation of the present invention.

Referring to FIG. 8 to FIG. 8B, a cone-shaped flared channel 21 is disposed between each reduced control hole 50 and each heat exchange channel 20. Through the flared channel 21, a dead angle between the reduced control hole 50 and the heat exchange channel 20 is avoided, and the space of each heat exchange channel 20 is used effectively.

Figure 5:
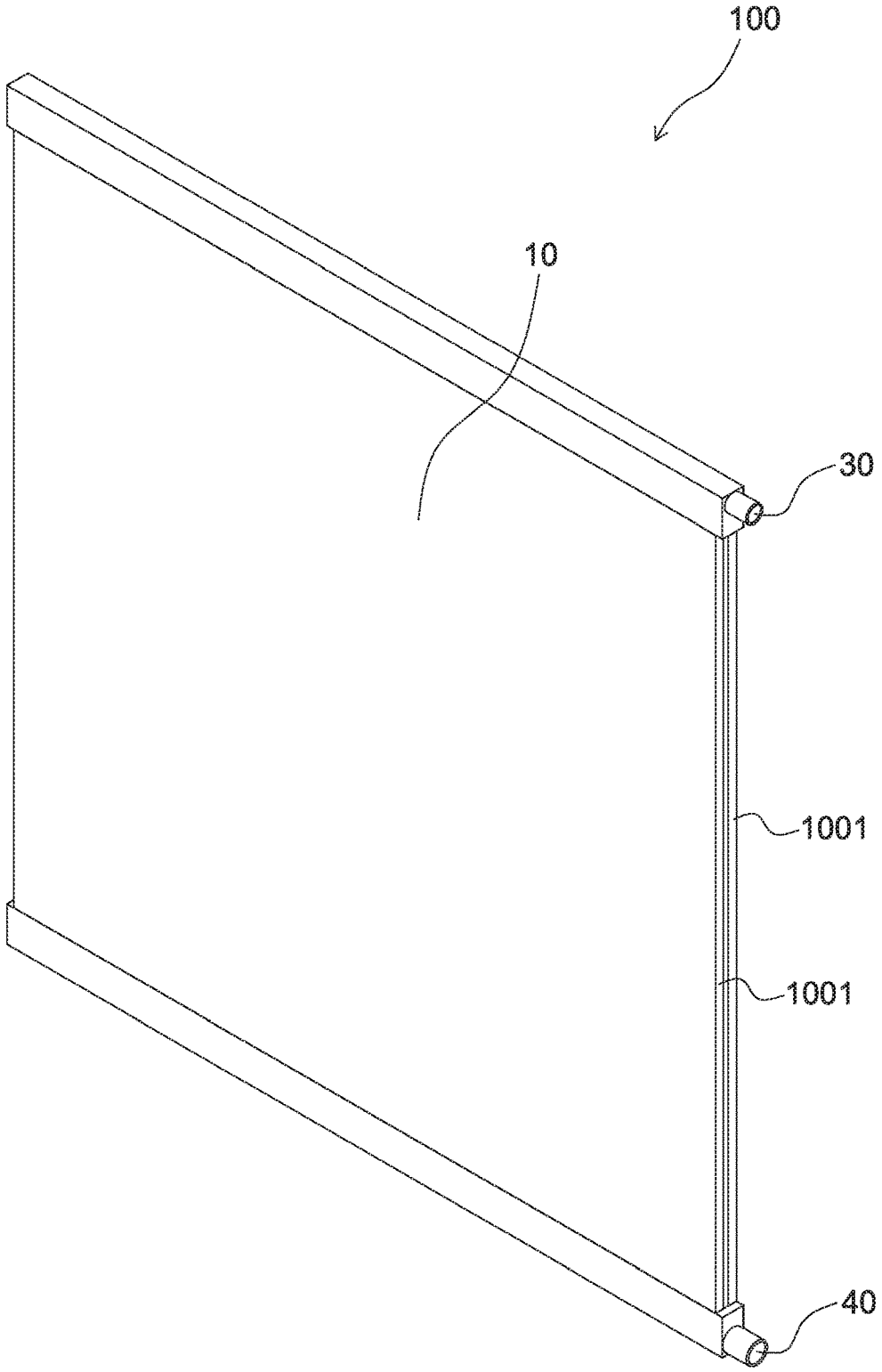
FIG. 5 is a perspective view of the present invention.
Figure 6:
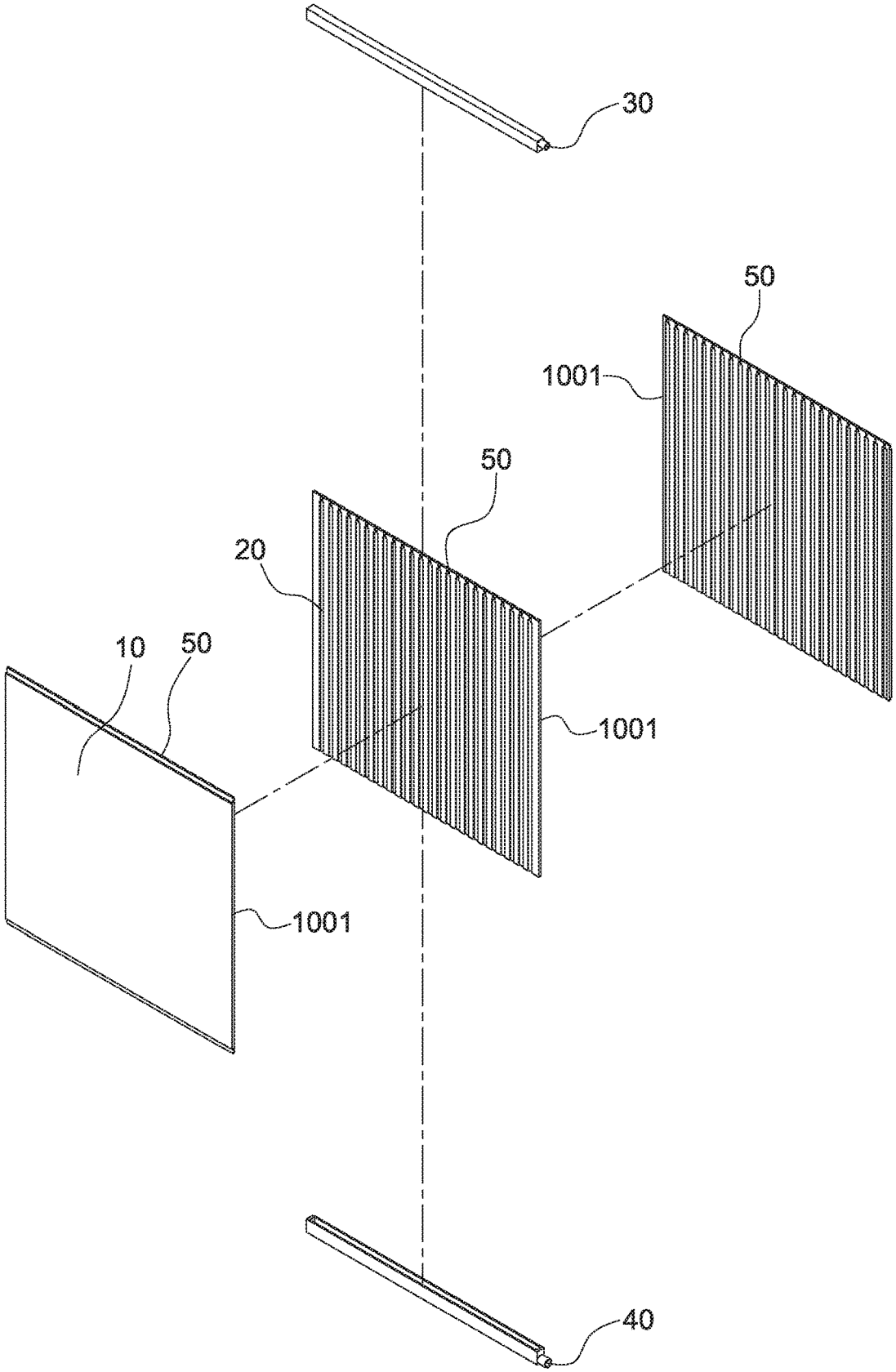
FIG. 6 is a first exploded view of the present invention.
Figure 7A:
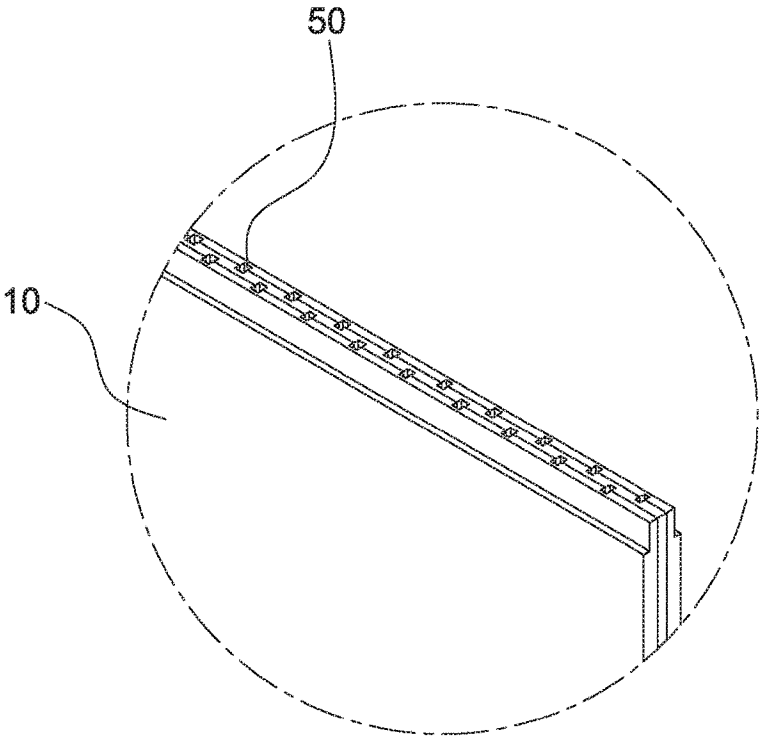
FIG. 7A is an enlarged view taken from circle A of FIG. 7.
Figure 7:
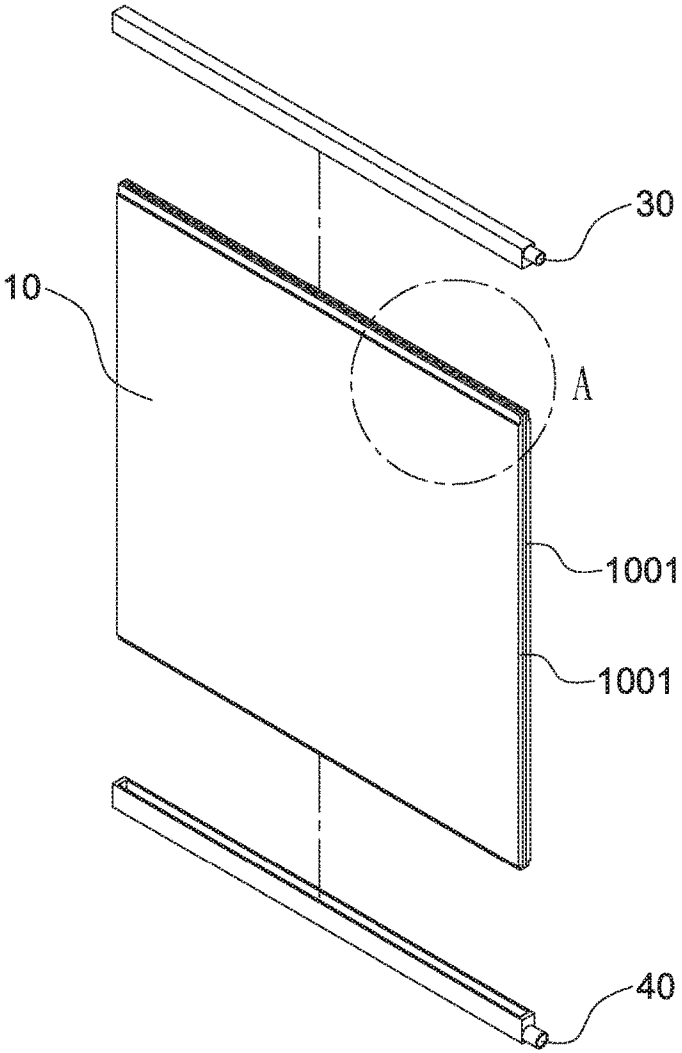
FIG. 7 is a second exploded view of the present invention.

Referring to FIG. 5 to FIG. 7, the heat exchange panel 100 is formed by combining at least two panel bodies 1001. In this embodiment, the heat exchange panel 100 is formed by combining three panel bodies 1001. Through the at least two panel bodies 1001, the heat exchange panel can be easily processed and manufactured by sheet metal forming, stamping, or CNC precision milling.

Referring to FIGS. 8A to 9 and FIG. 4, the water inlet channel 30 is connected to a water inlet pipe 32. The high-pressure water from the high-pressure pump 70 is conveyed into the water inlet channel 30 through the water inlet pipe 32. The water outlet channel 40 is connected to a recycling water pipe 42. The cooling liquid after absorbing heat is returned to the cooler 80 through the recycling water pipe 42.

Furthermore, referring to FIG. 8A to FIG. 8B, the cross-sectional area of each reduced control hole 50 can be adjusted according to the flow demand.

Preferably, the cross-sectional area of each reduced control hole 50 is gradually enlarged from the reduced control hole 50 close to a water inlet end 301 of the water inlet channel 30 to the reduced control hole 50 close to a tail closed end 302 of the water inlet channel 30.

Finally, the cross-sectional area of each reduced control hole 50 is incrementally set, a1, a2, a3 to aN, from the water inlet end 301 to the tail closed end 302, thereby avoiding the reduced control holes 50 adjacent to the water inlet end 301 to take away the flow of the reduced control holes 50 adjacent to the tail closed end 302, so as to achieve an average flow rate of the cooling liquid.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A thin heat exchange panel, comprising at least one contact side that is in contact with a heat source and a plurality of parallel and upright heat exchange channels disposed in the contact side, two ends of each heat exchange channel communicating with a water inlet channel for inputting high-pressure water and a water outlet channel connected to a cooler respectively, a reduced control hole being disposed between each heat exchange channel and the water inlet channel;

a cross-sectional area of each reduced control hole being added up, which being less than or equal to a cross-sectional area of the water inlet channel, a cross-sectional area of each heat exchange channel being added up, which being less than or equal to a cross-sectional area of the water outlet channel, the cross-sectional area of the water inlet channel being less than the cross-sectional area of the water outlet channel.

2. The thin heat exchange panel as claimed in claim 1, wherein a cone-shaped flared channel is disposed between each reduced control hole and each heat exchange channel.

3. The thin heat exchange panel as claimed in claim 1, wherein the heat exchange panel is formed by combining at least two panel bodies.

4. The thin heat exchange panel as claimed in claim 1, wherein the water inlet channel is connected to a water inlet pipe; the water outlet channel is connected to a recycling water pipe.

5. The thin heat exchange panel as claimed in claim 1, wherein the cross-sectional area of each reduced control hole is adjustable according to a flow demand.

6. The thin heat exchange panel as claimed in claim 5, wherein the cross-sectional area of each reduced control hole is gradually enlarged from the reduced control hole close to a water inlet end of the water inlet channel to the reduced control hole close to a tail closed end of the water inlet channel.

7. The thin heat exchange panel as claimed in claim 6, wherein the cross-sectional area of each reduced control hole is incrementally set from the water inlet end to the tail closed end.

* * * * *